US009348309B2

(12) United States Patent
Fujita et al.

(10) Patent No.: US 9,348,309 B2
(45) Date of Patent: May 24, 2016

(54) IMAGE FORMING APPARATUS AND DRIVING METHOD FOR DRIVING IMAGE FORMING APPARATUS

(71) Applicants: Masanari Fujita, Osaka (JP); Yasuhide Matsuno, Osaka (JP); Shin Murayama, Hyogo (JP); Shin Yamamoto, Osaka (JP); Shinichi Arasawa, Hyogo (JP)

(72) Inventors: Masanari Fujita, Osaka (JP); Yasuhide Matsuno, Osaka (JP); Shin Murayama, Hyogo (JP); Shin Yamamoto, Osaka (JP); Shinichi Arasawa, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/618,481

(22) Filed: Feb. 10, 2015

(65) Prior Publication Data

US 2015/0234348 A1 Aug. 20, 2015

(30) Foreign Application Priority Data

Feb. 18, 2014 (JP) ..... 2014-028653

(51) Int. Cl.

| | |
|---|---|
| ***G03G 15/00*** | (2006.01) |
| ***G03G 21/20*** | (2006.01) |
| ***G03G 21/00*** | (2006.01) |
| ***G03G 15/02*** | (2006.01) |

(52) U.S. Cl.

CPC ..... *G03G 21/20* (2013.01); *G03G 15/0225* (2013.01); *G03G 21/0005* (2013.01); *G03G 2221/0005* (2013.01); *G03G 2221/0026* (2013.01)

(58) Field of Classification Search

CPC ..... G03G 15/0225; G03G 21/0005; G03G 21/20; G03G 2221/0005; G03G 2221/0026

See application file for complete search history.

(56) References Cited

U.S. PATENT DOCUMENTS

| | | | | |
|---|---|---|---|---|
| 5,442,428 | A * | 8/1995 | Takahashi et al. | 399/302 |
| 2007/0286636 | A1* | 12/2007 | Inada et al. | 399/101 |
| 2011/0182596 | A1* | 7/2011 | Ishii | 399/31 |

FOREIGN PATENT DOCUMENTS

| | | |
|---|---|---|
| JP | 2-158790 | 6/1990 |
| JP | 2003-015471 | 1/2003 |
| JP | 2003-323079 | 11/2003 |
| JP | 2007-101909 | 4/2007 |
| JP | 2007-333810 | 12/2007 |
| JP | 2010-243830 | 10/2010 |

* cited by examiner

*Primary Examiner* — Ryan Walsh

(74) *Attorney, Agent, or Firm* — Harness, Dickey & Pierce, P.L.C.

(57) ABSTRACT

An image forming apparatus includes a latent image bearer, a charging roller, a first cleaner, a second cleaner, and a rotation controller. The latent image bearer bears a latent image on a surface thereof. The charging roller charges the latent image bearer. The first cleaner cleans the surface of the latent image bearer. The second cleaner cleans a surface of the charging roller. The rotation controller controls the latent image bearer to execute a set of backward rotation and first forward rotation at least once during a non-image formation time period, and either temporarily stop and start second forward rotation or continuously execute the second forward rotation by a rotation distance corresponding to at least one rotation of the charging roller.

20 Claims, 5 Drawing Sheets

IMAGE FORMING APPARATUS AND DRIVING METHOD FOR DRIVING IMAGE FORMING APPARATUS

CROSS-REFERENCE TO RELATED APPLICATION

This patent application is based on and claims priority pursuant to 35 U.S.C. §119(a) to Japanese Patent Application No. 2014-028653, filed on Feb. 18, 2014 in the Japan Patent Office, the entire disclosure of which is hereby incorporated by reference herein.

BACKGROUND

1. Technical Field

Embodiments of this invention relate to an image forming apparatus, such as a copier, a printer, a facsimile machine, a multifunction peripheral composed of these devices, etc., that includes a latent image bearer to bear a latent image on a circumferential surface thereof. The embodiments of this invention also relate to a driving method for driving the image forming apparatus.

2. Related Art

In the image forming apparatus, a charger electrically charges a photoconductive drum acting as a latent image bearer that then bears a latent image thereon. Then, a developing unit develops the latent image into a toner image that is then transferred onto a recording medium in developing and transfer processes, respectively. Subsequently, a first cleaner that contacts the photoconductive drum removes toner remaining on the photoconductive drum as developer residue.

In such an image forming apparatus, paper dust or the like sometimes stuffs a gap between the cleaner and the latent image bearer, thereby causing defective cleaning and ultimately resulting in a poor or defective image.

To prevent the occurrence of a defective image, the photoconductive drum is enabled to rotate both forward and backward when the image forming apparatus is not forming images. That is, the photoconductive drum is rotated backward at the time to apply a prescribed force in a backward direction to a cleaning blade that contacts the photoconductive drum and removes the paper dust or the like filling the gap between a tip of the cleaning blade and the surface of the photoconductive drum.

SUMMARY

One aspect of the present invention provides a novel image forming apparatus including a latent image bearer, a charging roller, a first cleaner, a second cleaner, and a rotation controller. The latent image bearer bears a latent image on a surface thereof. The charging roller charges the latent image bearer. The first cleaner cleans the surface of the latent image bearer. The second cleaner cleans a surface of the charging roller. The rotation controller controls the latent image bearer to execute a set of backward rotation and first forward rotation at least once during a non-image formation time period, and either temporarily stop and start second forward rotation or continuously execute the second forward rotation by a rotation distance corresponding to at least one rotation of the charging roller.

Another aspect of the present invention provides a novel method of driving an image forming apparatus. The method includes the steps of bearing a latent image on a circumferential surface of a latent image bearer, charging the latent image bearer with a charging roller, cleaning the surface of the latent image bearer with a first cleaner, and cleaning a surface of the charging roller with a second cleaner, executing a set of backward rotation and first forward rotation of the latent image bearer at least once during a non-image formation time period, and either temporarily stopping and starting second forward rotation of the latent image bearer or continuously executing the second forward rotation of the latent image bearer by a distance corresponding to at least one rotation of the charging roller.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Although the substances (i.e., paper dust or the like) remaining on the tip of the cleaning blade can be periodically removed by such backward rotation in the conventional system, toner either passing through the cleaning blade before the substances are removed or not completely removed by it migrates downstream and adheres to an electric charging roller resulting in defective electrostatic charging as a problem. Under such circumstances, an embodiment of the present invention is to provide an image forming apparatus capable of constantly form an image by effectively removing foreign substances attached to a component of an image forming section, such as a latent image bearer, a cleaner, an electric charging roller, etc.

Figure 1:
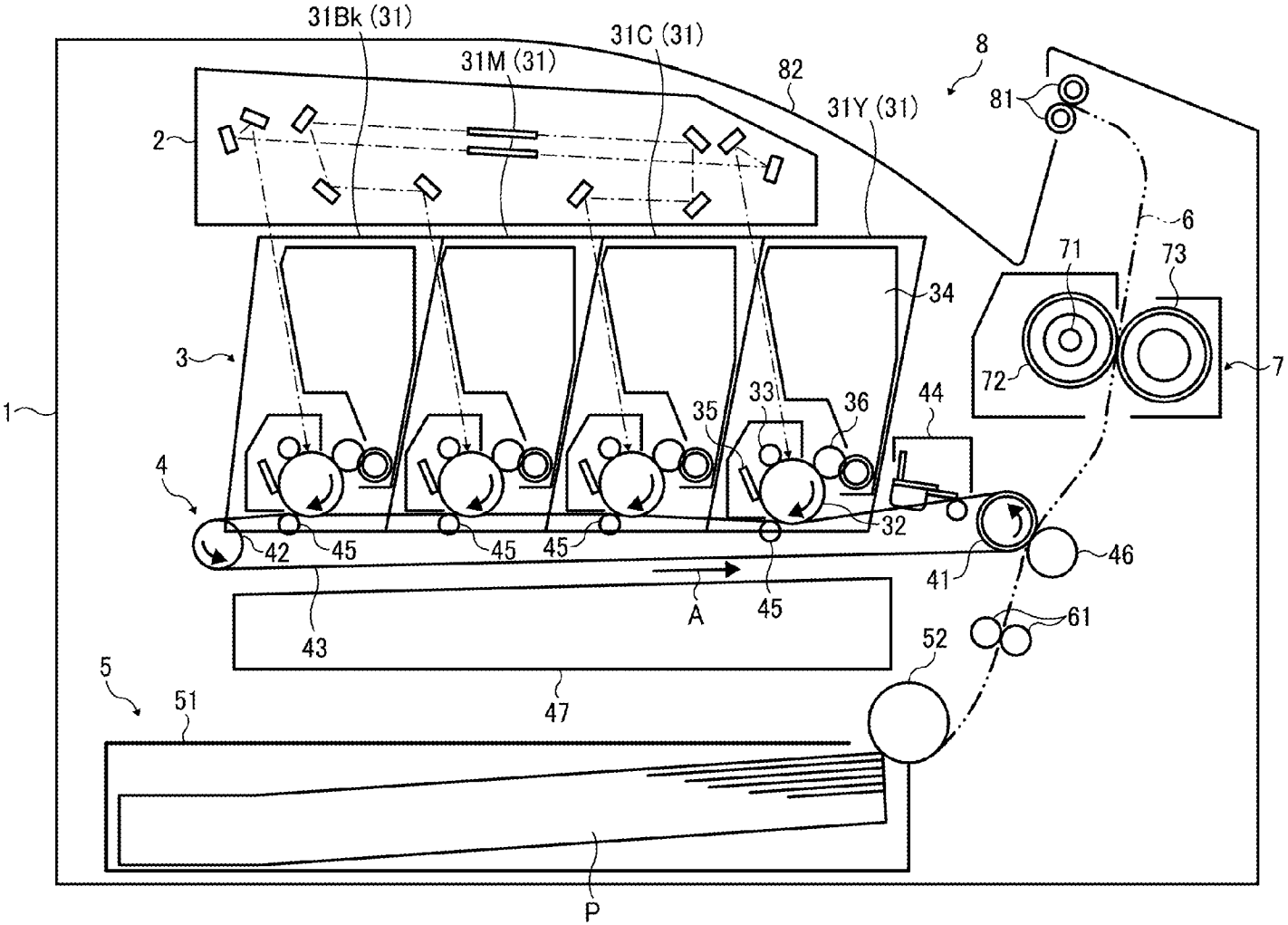
FIG. 1 is a diagram schematically illustrating a configuration of an image forming apparatus to which various embodiments of the present invention are applied.

Referring now to the drawings, wherein like reference numerals designate identical or corresponding parts throughout the several views thereof, and in particular to FIG. 1, an image forming apparatus 1 is configured as an exposure unit 2, an image forming system 3, a transfer unit 4, a sheet feeding unit 5, a sheet conveyance path 6, a fixing unit 7, and a sheet ejecting unit 8 or the like.

The exposure unit 2 is located at an upper section in the image forming apparatus 1 and is configured as a light source to emit a laser light beam or the like and various optical systems as well. Specifically, the exposure unit 2 irradiates laser light beams having separated color components of an image to the below described photoconductive drums provided in the image forming system 3 based on image data obtained from an image acquisition device, not shown, thereby exposing surfaces of the respective photoconductive drums.

The image forming system 3 is located below the exposure unit 2 and includes multiple process cartridges 31 each removable from the image forming apparatus 1. Each of the process cartridges 31 is configured as a photoconductive drum 32 acting as a latent image bearer capable of bearing a latent image on a circumferential surface thereof, an electric charging roller 33 acting as an electric charging roller that electrically charges a surface of the photoconductive drum 32 uniformly, a developing unit 34 capable of bearing toner as developer on a circumferential surface thereof and applying the toner to the surface of the photoconductive drum 32 to develop the latent image, and a photoconductive drum cleaning blade 35 acting as a first cleaner (in the present embodiment, it is made of urethane rubber) to clean the surface of the photoconductive drum 32 or the like. The process cartridges (31Y, 31C, 31M, and 31Bk) accommodate different color components of yellow, cyan, magenta, and black separated from a color image, respectively, and are configured to be independently removable from the image forming apparatus 1. Because these process cartridges 31 have similar configurations except for storing different color toner particles from the other, reference numbers and suffixes to indicate prescribed components included therein are omitted here for the purpose of simplicity.

The transfer unit 4 is located beneath the image forming system 3 and is configured as an endless intermediate transfer belt 43 entrained around a driving roller 41 and a driven roller 42 to rotate therearound, a cleaning blade 44 to clean a surface of the intermediate transfer belt 43, and multiple primary transfer rollers 45 opposite the photoconductive drum 32 of the respective process cartridges 31 with the intermediate transfer belt 43 or the like being interposed therebetween. Each of the primary transfer rollers 45 presses against an inner circumferential surface of the intermediate transfer belt 43 at each of positions thereof, so that a primary transfer nip is formed between a portion of the intermediate transfer belt 43 pressed by the primary transfer roller 45 and the corresponding photoconductive drum 32.

In the transfer unit 4, a driving roller 41 is also disposed to drive the intermediate transfer belt 43. A secondary transfer roller 46 is also disposed while facing the driving roller 41 via the intermediate transfer belt 43. The secondary transfer roller 46 presses against an outer circumferential surface of the intermediate transfer belt 43, so that a secondary transfer nip is formed at a section at which the secondary transfer roller 46 and the intermediate transfer belt 43 contact each other. Further, a waste toner container 47 is disposed below the intermediate transfer belt 43 to accommodate waste toner collected by the cleaning blade 44 through a waste toner transfer hose, not shown.

The sheet feeding unit 5 is located at a bottom of the image forming apparatus 1 and is configured as a sheet feeding cassette 51 loading multiple recording sheets P as recording media and a sheet feeding roller 52 to launch the recording sheet P into the sheet conveyance path 6 defined internally by various components from the sheet feeding cassette 51.

Along the sheet conveyance path 6, to convey the recording sheet P therealong after it is launched thereinto from the sheet feeding unit 5, multiple pairs of transfer rollers, not shown, including a pair of registration rollers 61 is disposed at prescribed respective positions on the way until the below described sheet ejecting unit 8.

The fixing unit 7 has a fixing roller 72 heated by a heating source 71 and a pressing roller 73 that presses against the fixing roller 72.

The sheet ejecting unit 8 may be provided at the downstream end of the sheet conveyance path 6 of the image forming apparatus 1 and includes a pair of sheet ejecting rollers 81 to drain the recording sheet P to an outside and a sheet ejection tray 82 as well to stack the recording sheet P ejected thereonto as well.

Now, with reference to FIG. 1, basic operation of the above-described image forming apparatus 1 is described in detail.

When image forming operation is initiated in the image forming apparatus 1, multiple electrostatic latent images are formed on the surfaces of the respective photoconductive drums in the process cartridges 31Y, 32C, 31M, and 31Bk. Here, monochromatic image information including component colors of yellow, cyan, magenta, and black obtained by separating a prescribed full-color image thereinto are used to expose the respective photoconductive drums 32. Hence, the multiple electrostatic latent images are formed on the respective photoconductive drums 32, and toner particles stored in the developing units 34 are then supplied to the photoconductive drums 32 by the respective developing rollers 36. Consequently, the multiple electrostatic latent images are rendered visible as toner images (i.e., developed images) of the respective component colors.

Subsequently, as the driving roller 41 of the transfer unit 4 is driven and rotated counterclockwise in the drawing, the intermediate transfer belt 43 is driven to run in the direction indicated by arrow A in the drawing. To each of the primary transfer rollers 45, a constant voltage or a voltage under constant current control having a reverse polarity to a charged polarity of toner is applied. With this, multiple transfer electric fields are formed at primary transfer nips between the primary transfer rollers 45 and the corresponding photoconductive drums 32, respectively. Hence, respective color toner images formed on the photoconductive drums 32 of the process cartridges 31Y, 31C, 31M, and 31Bk are successively transferred and superimposed on the intermediate transfer belt 43 at the above-described respective primary transfer nips under the transfer electric fields. Hence, a full-color toner image is formed on the surface of the intermediate transfer belt 43. Some of the toner particles remaining on the respective photoconductive drums 32 after the primary transfer processes are removed by the photoconductive drum cleaning blades 35 and are collected and accommodated in the waste toner container 47.

Meanwhile, at the bottom of the image forming apparatus 1, when the image forming operation is initiated, the sheet feeding roller 52 is driven and rotated, and a recording sheet P housed in the sheet feeding cassette 51 disposed in the sheet feeding unit 5 is launched into the sheet conveyance path 6. The recording sheet P sent out to the sheet conveyance path 6 stops at and is timed by the pair of registration rollers 61 and is further sent to the secondary transfer nip formed between the secondary transfer roller 46 and the driving roller 41 opposed to it. At that moment, to the secondary transfer roller 46, a transfer voltage having a reverse polarity to a charged polarity of toner in a toner image borne on the intermediate transfer belt 43 is again applied, so that a secondary transfer electric field is formed in the secondary transfer nip. Subsequently, under the secondary transfer electric field formed in the secondary transfer nip, the toner image P borne on the intermediate transfer belt 43 is transferred onto the recording sheet P at once.

The recording sheet P bearing the toner image transferred thereonto in this way is conveyed to the fixing unit 7 and is heated by a fixing roller 72 preheated by the heating source 71 and pressed by the pressing roller 73, so that the toner image can be fixed onto the recording sheet P. Subsequently, the recording sheet P bearing the toner image fixed thereonto in this way is separated from the fixing roller 72 and is further conveyed by a pair of conveyor rollers, not shown, downstream. The recording sheet P is after that ejected by a pair of sheet ejecting rollers 81 onto a sheet ejection tray 82 in the sheet ejecting unit 8. Here, residual toner adhering to the intermediate transfer belt 43 after the secondary toner image transfer process is removed by the cleaning blade 44 or the like. The toner removed in this way is conveyed by a screw and a waste toner transfer hose or the like, not shown, to be ultimately collected in the waste toner container 47.

Although, the above-described one embodiment of the image forming apparatus 1 simply forms the full-color image on the recording sheet P, either a single color image or dual or trivalent color images can be formed by the image forming apparatus 1 by optionally using one, two, or three of four process cartridges 31Y, 31C, 31M, and 31Bk, respectively, as well.

Figure 2:
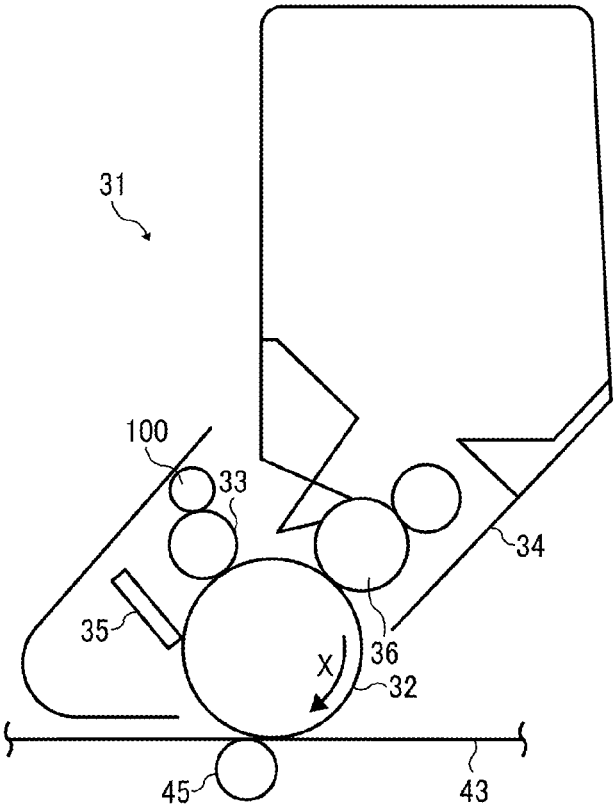
FIG. 2 is a cross-sectional view schematically illustrating an exemplary structure of a process cartridge included in the image forming apparatus of FIG. 1.

Now, an exemplary structure of a periphery of the process cartridge is described with reference to a diagram of FIG. 2. In general, toner remains adhering to a surface of the photoconductive drum 32 after a toner image is transferred onto the intermediate transfer belt 43. Thus, the photoconductive drum cleaning blade 35 contacting the photoconductive drum 32 removes such residual toner remaining after such a toner transferred process. Subsequently, the photoconductive drum 32 is electrically charged again by the charging roller 33 to perform the next image forming operation. Here, a cleaning roller 100 acting as a charging roller cleaner is provided to contact the electric charging roller 33 to clean a surface of the electric charging roller 33 by removing toner or the like adhering to the surface thereof.

Figure 3:
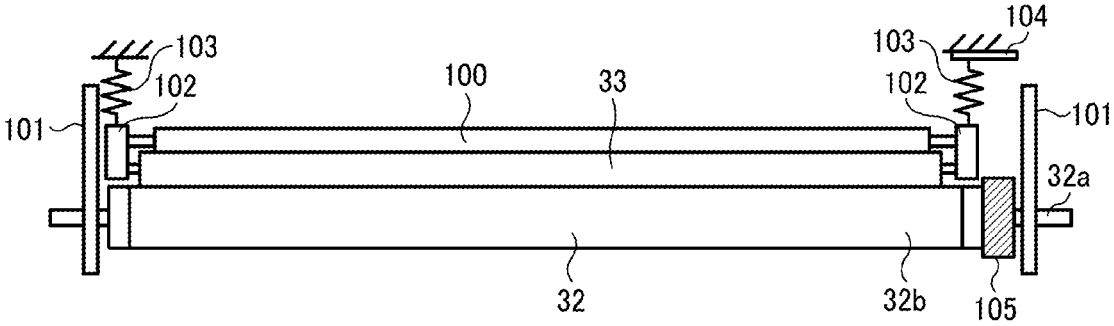
FIG. 3 is a diagram schematically illustrating a structure of an image forming section of the image forming apparatus to which various embodiments of the present invention are applied.

As shown in FIG. 3, the process cartridge 31 includes a pair of housing side-walls 101 to hold both ends of the photoconductive drum 32 in an axial direction thereof, respectively, and a pair of bearing members 102 to hold respective both ends of a rotary shaft 33*a* (see FIG. 4) of the electric charging roller 33 and a rotary shaft 100*a* (see FIG. 4) of the cleaning roller 100 as well, respectively. The process cartridge 31 also includes a pair of compression springs 103 that presses against the pair of bearing member 102, respectively, and a pair of electrode plates 104 or the like.

Here, the pair of housing side-walls 101 is placed at both ends of the photoconductive drum 32 in the axial direction thereof to freely rotatably hold both ends of the rotary shaft 32*a* of the photoconductive drum 32.

Specifically, at one end of the rotary shaft 32*a* of the photoconductive drum 32, a flange 105 is disposed to position the photoconductive drum 32. The flange 105 is fixed inside the housing side-wall 101 in an axial direction thereof at one end of a body portion 32*b* of the photoconductive drum 32 to regulate a position of the photoconductive drum 32 in the direction. The flange 105 also has a gear, not shown, on an outer circumferential surface thereof, and receives and then conveys driving force transmitted from a driving device, not shown, to the photoconductive drum 32 through the gear.

The rotary shaft 32*a* of the photoconductive drum 32 is connected to an inner wall of an element tube made of aluminum acting as a substrate of the body portion 32*b* via an electrode, not shown, and is ultimately grounded.

The electric charging roller 33 and the cleaning roller 100 have shafts extending in the same direction as the shaft of the photoconductive drum 32, and are disposed over the photoconductive drum 32 in a widthwise direction thereof, respectively. The electric charging roller 33 contacts the photoconductive drum 32. At the same time, the cleaning roller 100 contacts the electric charging roller 33 as well.

At respective both ends of the electric charging roller 33 and the cleaning roller 100 in the axial directions thereof, a pair of bearing members 102 is disposed to hold these members, respectively. Hence, each of the pair of bearing members 102 freely rotatably holds the electric charging roller 33 and the cleaning roller 100 commonly at one end thereof.

A pair of compression springs 103 is attached to the pair of bearing members 102, respectively. Specifically, as shown in FIG. 3, the pair of bearing members 102 is downwardly pressed by the pair of compression springs 103 from above toward the photoconductive drum 32, respectively, and accordingly, the electric charging roller 33 is also pressed in this direction to contact the photoconductive drum 32.

Above one of the pair of compression springs 103, the above-described electrode plate 104 is installed and is connected to a power supply, not shown, to receive electric power therefrom. Thus, via the electrode plate 104, the compression spring 103, and the bearing member 102, the electric power is supplied from the power supply to the electric charging roller 33.

The electric charging roller 33 is rotated by the photoconductive drum 32 while uniformly charging a surface of the photoconductive drum 32 as the photoconductive drum 32 rotates. At the same time, the cleaning roller 100 is similarly rotated by the electric charging roller 33 while removing foreign substances such as toner, etc., from the surface of electric charging roller 33 as electric charging roller 33 rotates.

Figure 4:
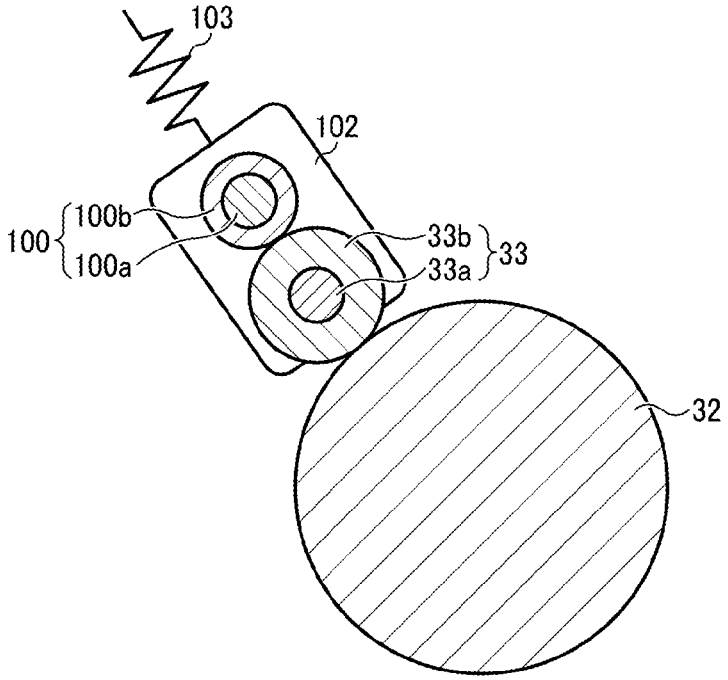
FIG. 4 is a cross-sectional view schematically illustrating a structure of an image forming section of the image forming apparatus to which various embodiments of the present invention are applied.

As shown in FIG. 4, the electric charging roller 33 is configured as the rotary shaft 33*a* made of metal and a conductive rubber layer 33*b* overlying an outer circumference of the rotary shaft 33*a*. The electric charging roller 33 constitutes a contact type charging system and uniformly charges a surface of the photoconductive drum 32 by bringing the conductive rubber layer 33*b* in contact with the photoconductive drum 32.

The cleaning roller 100 is configured as the rotary shaft 100*a* made of metal and an elastic layer 100*b* made of foamed urethane sponge overlying an outer circumference of the metal rotary shaft 100*a*, and contacts the electric charging roller 33 via the elastic layer 100*b*.

In general, when an image is formed, substances, such as toner, paper dust, etc., adheres to an image forming section, such as the photoconductive drum cleaning blade 35, the electric charging roller 33, etc., and sometimes causes defective image formation as described below. That is, a process of occurrence of such defective image formation is described in detail.

As described earlier, residual toner remaining on the surface of the photoconductive drum 32 after the transfer process is removed by the photoconductive drum cleaning blade 35 contacting the surface of the photoconductive drum 32. At this moment, however, paper dust adhering to the surface of the photoconductive drum 32 sometimes clogs a gap between the photoconductive drum cleaning blade 35 and the photoconductive drum 32 resulting in poor cleaning.

Specifically, the paper dust adheres to a surface of the photoconductive drum 32 in the below described manner. Initially, untransferred toner and paper dust or the like accumulate at an edge of the cleaning blade 44 that cleans the intermediate transfer belt 43 acting as a belt member. Before long, a small gap is created at the edges of the cleaning blade 44 resulting in poor cleaning performance. Consequently, the paper dust accumulates on the intermediate transfer belt 43 and is conveyed from the intermediate transfer belt 43 to the photoconductive drum 32 during an intermediate transfer process.

When cleaning performance of the photoconductive drum cleaning blade 35 deteriorates, residual toner and external additives added to the toner such as silica, etc., adhering to a surface of the photoconductive drum 32 are not sufficiently removed therefrom by the photoconductive drum cleaning blade 35 and remains thereon. The toner and external additives remaining in this way on the surface of the photoconductive drum 32 may then adhere to the electric charging roller 33 disposed downstream of the photoconductive drum 32 in a rotation direction thereof.

In addition to the above-described situation, even when the photoconductive drum cleaning blade 35 works fine, the toner or the like is not always completely removed and partially remains accordingly. That is, some of toner not removed in this way further migrates downstream and ultimately adheres to the electric charging roller 33 as well.

As described earlier, the substances such as toner, etc., adhering to the electric charging roller 33 is removed by the cleaning roller 100. However, especially when the photoconductive drum cleaning blade 35 causes the above-described defective cleaning, a great amount of substances sticks to the electric charging roller 33, so that all of them cannot be removed by the cleaning roller 100. For this reason, due to the foreign substances remaining in this way on it, the electric charging roller 33 cannot uniformly charge the photoconductive drum 32.

By contrast, according to one embodiment of the present invention, defective image formation is minimized or prevented by many countermeasures as described herein below.

Specifically, according to one embodiment of the present invention, in an image forming apparatus, when an image is not being formed, the photoconductive drum 32 is rotated backward in an opposite direction to that to rotate during image formation time period, and is then rotated in the same direction as it rotates during the image formation as a first forward rotation (hereinafter collectively referred to as a backward and forward rotation). Further, the backward and forward rotation is repeated.

That is, to eliminate the paper dust or the like clogging the gap between the photoconductive drum cleaning blade 35 and the photoconductive drum 32, the photoconductive drum 32 is rotated in the backward direction (i.e., opposite a direction to rotate during the image formation) to apply a prescribed amount of force to the paper dust or the like in the backward direction. With this, defective cleaning possibly caused by the photoconductive drum cleaning blade 35 and accordingly adhesion of the toner or the like to the electric charging roller 33 can be reduced at the same time.

However, although the above-described driving can solve the accumulation of the paper dust or the like in the gap between the photoconductive drum 32 and the photoconductive drum cleaning blade 35, paper dust is stuffed again due to image forming operation executed between successive backward and forward rotations, thereby temporarily staying in the gap between the photoconductive drum 32 and the photoconductive drum cleaning blade 35 and ultimately causing defective cleaning. In addition, even under normal conditions, since toner or the like is not completely removed by the photoconductive drum cleaning blade 35, a certain amount of toner further migrates downstream into and ultimately adheres to the electric charging roller 33.

Accordingly, to reduce the amount of toner migrating into the electric charging roller 33, a frequency of implementation of backward and forward rotation can be increased. However, when the backward and forward rotation is frequently implemented, although the paper dust or the like remaining on the photoconductive drum cleaning blade 35 can be frequently removed, silica or the like sandwiched between the photoconductive drum cleaning blade 35 and the photoconductive drum 32 is rubbed against and firmly adheres to a surface of the photoconductive drum 32. Consequently, such fixation of the silica or the like either damages a tip of the photoconductive drum cleaning blade 35 resulting in poor cleaning again or firmly sticks onto the surface of the photoconductive drum 32 and causes defective image formation, thereby raising a new problem.

For this reason, a given amount of toner not removed from the surface of the photoconductive drum 32 tends to adhere to the electric charging roller 33. Further, although the toner adhering to the electric charging roller 33 is partially removed from the electric charging roller 33 by the cleaning roller 100 operated during the image formation, defective image formation cannot be sufficiently prevented.

According to one embodiment of the present invention, to prevent the defective image formation caused in this way due to firmly sticking of the substances to the electric charging roller 33, the photoconductive drum 32 is forced to execute a second forward rotation motion (hereinafter referred to as idling rotation driving) in a non-image formation time period after the above-described backward and forward rotation to remove the toner or the like yet adhering to a surface of the electric charging roller 33.

That is, since the idling rotation driving is executed during the non-image formation time period, the toner or paper dust does not migrate to the image forming section as different from when an image is formed. Accordingly, in this situation, by driving the image forming section and accordingly cleaning the electric charging roller 33 mainly with a function of the cleaning roller 100, the aforementioned defective image formation can be likely prevented.

Figure 5:
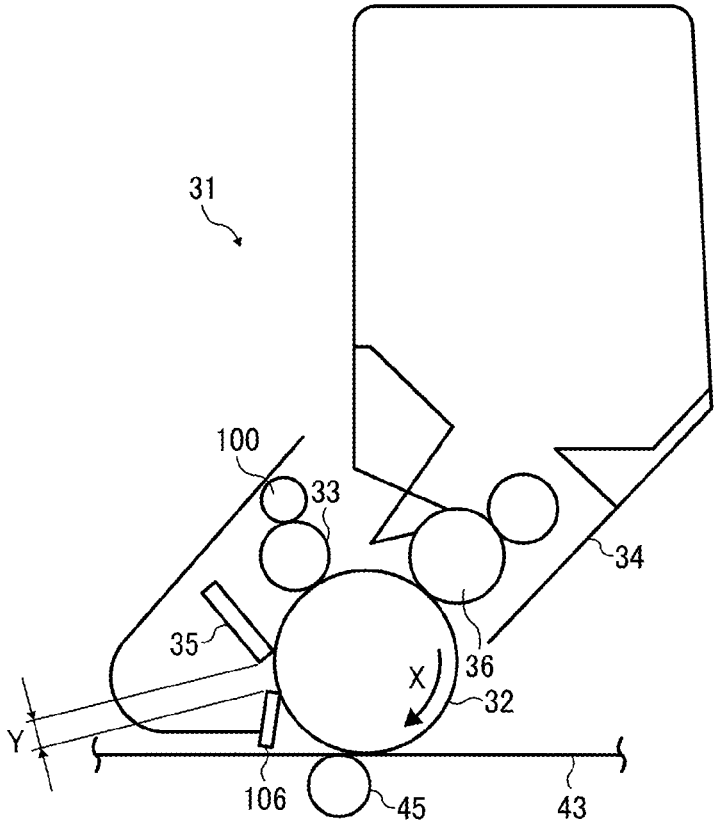
FIG. 5 is a cross-sectional view schematically illustrating an exemplary structure of an image forming section of the image forming apparatus according to one embodiment of the present invention.

Further, as shown in FIG. 5, to prevent backflow of removed matter (i.e., toner or paper dust) during the backward rotation of the photoconductive drum 32, a non-return valve 106 is provided in the image forming apparatus of this embodiment of the present invention. Specifically, the non-return valve 106 is placed between the photoconductive drum cleaning blade 35 and the primary transfer roller 45 while contacting a surface of the photoconductive drum 32. The non-return valve 106 is separated from the photoconductive drum cleaning blade 35 by a distance Y along the circumference of the photoconductive drum 32 as shown in FIG. 5.

That is, when the photoconductive drum 32 rotates in reverse during the backward and forward rotation, accumulation of the toner at the tip of the photoconductive drum cleaning blade 35 is dissolved and the toner migrates in an opposite direction to that as shown by arrow X on the surface of the photoconductive drum 32.

At this moment, however, since the non-return valve 106 catches the toner or the like removed by the photoconductive drum cleaning blade 35 during the backward rotation and migrating thereto along the surface of the photoconductive drum 32, the toner or the like is prevented from further migrating toward the intermediate transfer belt 43 and the primary transfer roller 45 as well.

Accordingly, to prevent the toner removed during the backward rotation from migrating through the non-return valve 106 toward the intermediate transfer belt 43, a rotation distance of the photoconductive drum 32 in the reversing forward rotation is set within the distance Y. That is, a point on a circumference of the photoconductive drum 32 contacting the photoconductive drum cleaning blade 35 at a backward and forward rotation start time point travels within the distance Y.

In one embodiment of the present invention, the distance Y is set to about 3 mm. Accordingly, the maximum possible distance for the photoconductive drum 32 to move from the starting point at which the backward and forward rotation is started in the opposite direction to that as shown by arrow X is about 3 mm or less.

Figure 8:
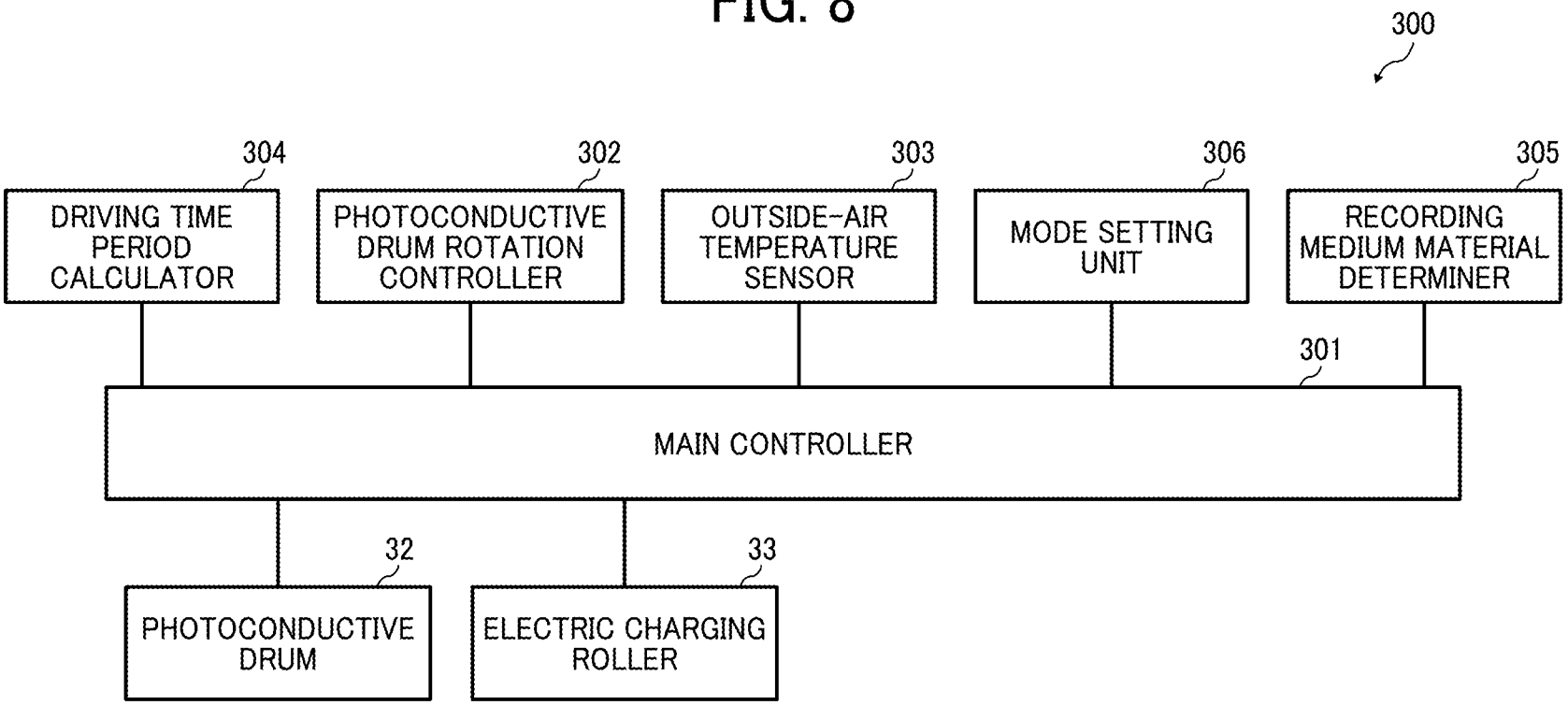
FIG. 8 is a block chart schematically illustrating an exemplary control system included in the image forming apparatus according to one embodiment of the present invention.

Further, to execute the preferred cleaning operation, a control system 300 is provided in this embodiment of the present invention as shown in FIG. 8. Specifically, the number of backward and forward rotation executions and an idling rotation driving time period (herein below collectively referred to as a rotation condition) are changed and set by a photoconductive drum rotation controller 302 connected to a main controller 301 in accordance with the ambient temperature detected by an outside-air temperature sensor 303, the total operating time of the image forming section measured by a driving time period calculating unit 304, and the physical properties of the recording medium on which an image is formed detected by a recording medium material determiner 305.

Here, one cycle of the backward and forward rotation is defined such that the photoconductive drum 32 is rotated backwardly by about 2 mm, forwardly by about 1 mm, and backwardly again by about 2 mm, and forwardly again about 3 mm, respectively. That is, per backward and forward rotation cycle, the backward rotation and the first forward rotation are executed twice, respectively. Accordingly, three cycles of the backward and forward rotation means that the above-described one cycle is repeated three times. In any case, in this situation, at every cycle of the backward and forward rotation, the photoconductive drum 32 returns to a home position located before the backward and forward rotation thereof is commenced. At the same time, the maximum distance of the backward movement thereof is about 2 mm less than the distance Y of about 3 mm.

Although a distance to rotate the photoconductive drum 32 is decided in this way, because the photoconductive drum 32 is simply needs to be rotated by a certain distance, the distance may range from about 1 mm to about 10 mm and more. In such a situation, the non-return valve 106 may be placed as appropriate, thereby changing the distance Y in keeping with the above-described range.

Further, in this embodiment of the present invention, an outer diameter of the photoconductive drum 32 is set to about 30 mm, a peripheral speed thereof is set to about 240 [mm/s], and an outer diameter of the electric charging roller 33 is set to about 9.5 [mm]. Here, effectiveness of cleaning of the charging roller 33 by executing the idling rotation driving varies depending on a condition such as ambient temperature, etc. However, a prescribed level of effectiveness of cleaning of the charging roller 33 by executing the idling rotation driving can be obtained when the photoconductive drum 32 rotates 240 times or more, i.e., rotates for 30 seconds or more.

However, the rotation distance of the idling rotation driving is not limited to the above-described value. For example, because the cleaning roller 100 can entirely clean a periphery of the electric charging roller 33 when the electric charging roller 33 rotates at least once, sufficient cleaning performance can be obtained as long as the photoconductive drum 32 rotates and moves a prescribed distance enabling the electric charging roller 33 to rotate once or more.

Here, the idling rotation can be executed after the backward and forward rotation as follows. That is, the last forward rotation executed in the backward and forward rotation (i.e., the lastly executed first forward rotation in the one cycle) and the idling rotation driving (i.e., the second forward motion) can be continuously executed to constitute one forward rotation. Otherwise, the photoconductive drum 32 temporarily stops after the last forward rotation, and the idling rotation driving resumes (in the forward direction) again thereafter.

Herein below, various changes in rotation condition made under various conditions are described in order.

Firstly, a rotation condition is changed in accordance with the ambient temperature as initially described below. The image forming apparatus 1 includes an outside-air temperature sensor 303 as an air temperature detector, and changes the rotation condition based on the air temperature measured by the outside-air temperature sensor 303.

That is, under low-temperature conditions, the photoconductive drum cleaning blade 35 made of urethane rubber decreases rebound resilience, and accordingly paper dust easily clogs the gap formed between the tip of the photoconductive drum cleaning blade 35 and the photoconductive drum 32.

To resolve a problem raised in such low-temperature conditions, the number of backward and forward rotation executions is relatively increased according to one embodiment of the present invention. Specifically, when a threshold of the air temperature as environment is set to about 15 degree Celsius, and the air temperature measured is about 15 degree Celsius or less, the idling rotation driving is executed for about 15 seconds after three cycles of the backward and forward rotation. By contrast, when the air temperature is about 15 degree Celsius or more, the idling rotation driving is executed for about 45 seconds after one cycle of the backward and forward rotation.

Secondly, the rotation condition is also changed in accordance with a cumulative driving time period of the image forming section as described below. That is, in this embodiment of the present invention, a driving time period calculator 304 is provided to accumulate driving time periods of the photoconductive drum 32 or the like. With this, the rotation condition is changed in accordance with the cumulative driving time period calculated by the driving time period calculator 304.

That is, when the total driving time period of the photoconductive drum 32 increases, the tip of the photoconductive drum cleaning blade 35 increasingly wears out thereby degrading cleaning performance thereof likely resulting in occurrence of clogging of the paper dust or the like and defective cleaning as well.

To resolve such a problem in this embodiment of the present invention, when the cumulative driving time period exceeds a given threshold, the number of backward and forward rotation executions is relatively increasingly set. Specifically, until the cumulative driving time period arrives at about ⅔ of a lifetime of the photoconductive drum 32 calculated based on a driving time period thereof, the idling rotation driving is executed for about 45 seconds after one cycle of the backward and forward rotation. However, in the remaining ⅓ of the lifetime of the photoconductive drum 32, the idling rotation driving is executed for about 15 seconds after three cycles of the backward and forward rotation.

Here, although the driving time period of the photoconductive drum 32 is measured as a condition to determine the rotation time period, an image formation time period taken by the image forming apparatus 1 can be also measured as the condition as well.

Thirdly, the rotation condition is also changed in accordance with the physical properties of the recording medium as described below. Specifically, in this embodiment of the present invention, a rotation condition is changed by investigating the physical properties of the recording medium.

That is, since accumulation of paper dust tends to accumulate at the tip of the photoconductive drum cleaning blade 35 when a recording media used in image formation contains a great amount of the paper dust, the number of backward and forward rotation executions needs to be increased.

Therefore, the following systems are employed. For example, a material property measuring device 305 is provided in the image forming apparatus 1 to measure material properties of a recording medium and determines the rotation condition based on information obtained by the material property measuring device 305. Otherwise, countries and regions are each classified, for example, into two types in advance, in which a recording medium with a great amount of paper dust is relatively frequently used and it is not relatively frequently used, respectively, and the rotation condition is set in advance in accordance with the type thereof.

Specifically, under a condition in which a recording medium contains relatively a large amount of paper dust, the idling rotation driving is executed for about 15 seconds after three cycles of the backward and forward rotation. By contrast, under another condition in which a recording medium contains a relatively small amount of paper dust, the idling rotation driving is executed for about 45 seconds after one cycle of the backward and forward rotation until the above-described image forming section (i.e., the photoconductive drum 32) arrives at about ⅔ of a lifetime thereof supposed based on a driving time period thereof. By contrast, in the remaining ⅓ of the lifetime, the idling rotation driving is executed for about 15 seconds after three cycles of the backward and forward rotation.

Although it is determined in this way based on the ambient temperature, the total number of operating times of the image forming section, and the physical properties of the recording medium in this way, the rotation condition can be also determined either simply based on various combinations of those conditions or is determined based a priority given condition among them. That is, the rotation condition can be optionally determined by changing conditions as needed.

Hence, a series of the backward and forward rotation and the idling rotation driving executed thereafter can be either automatically executed by the image forming apparatus 1 periodically based on a condition such as a driving time period of an image forming section, etc., or manually executed by a user as well.

For example, as multiple modes allowed to a user to use, a so-called charging roller cleaning important mode, in which the backward and forward rotation is relatively short while the idling rotation driving is executed relatively for a long time, and a so-called cleaning blade edge cleaning important mode, in which the backward and forward rotation is relatively long while the idling rotation driving is executed for relatively a short time, are prepared, so that the user can alternatively execute these two modes.

Specifically, in the charging roller cleaning important mode, the idling rotation driving is executed for about 45 seconds after one cycle of the backward and forward rotation. By contrast, in the cleaning blade edge cleaning important mode, the idling rotation driving is executed for about 15 seconds after three cycles of the backward and forward rotation.

Further, when a defective image is formed, the user is encouraged first to conduct the charging roller cleaning important mode to reduce a risk of sticking of silica or the like to a surface of the photoconductive drum 32. When the defective image is yet formed and is not improved, the user is encouraged next to conduct the cleaning blade edge cleaning important mode for the same purpose.

Further, as a charging roller cleaner that cleans the electric charging roller 33, various types can be employed other than the above-described cleaning roller 100 as shown in FIG. 4.

Figure 6:
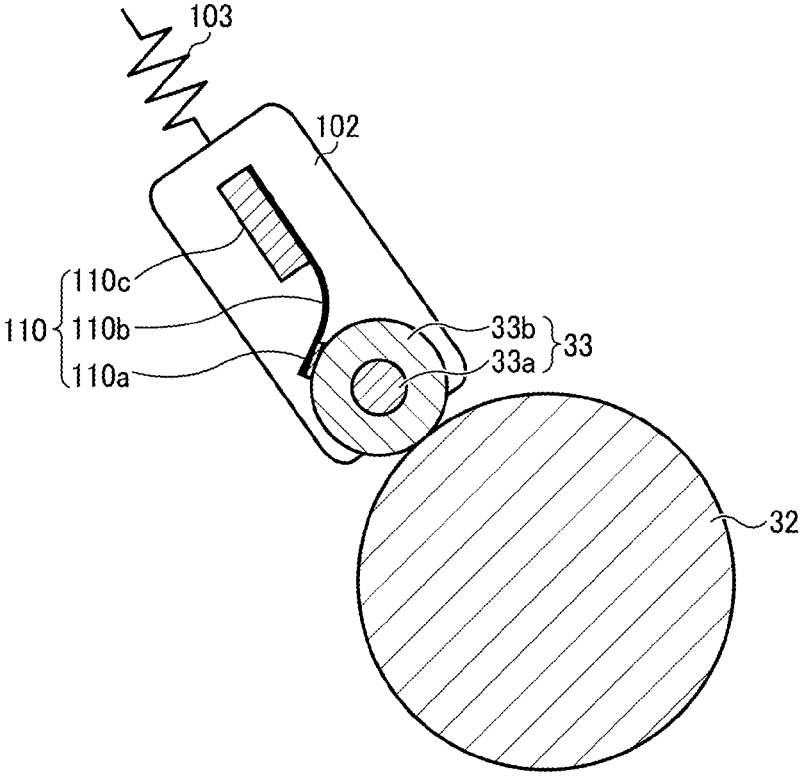
FIG. 6 is a cross-sectional view schematically illustrating an exemplary structure of another image forming section of the image forming apparatus according to a first modification of one embodiment of the present invention.

FIG. 6 illustrates a first modification of a charging roller cleaner employed in an image forming apparatus of the present invention. That is, in the charging roller cleaner of the first modification, instead of the cleaning roller 100, a cleaning sheet unit 110 configured by an elastic sheet 110*a* made of foamed urethane, an elastic linkage 110*b* made of PET (polyethylene terephthalate), and a planar stay 110*c* made of metal are disposed.

Specifically, similar to the cleaning roller 100 of FIG. 4, the elastic sheet 110*a*, the elastic linkage 110*b*, and the planar stay 110*c* extend in an axial direction of the electric charging roller 33, and both ends of the planar stay 110*c* in an axial direction thereof are held by the bearing members 102, respectively.

The elastic sheet 110*a* is a sheet-shaped elastic member and removes the toner or the like adhering to the electric charging roller 33 by contacting the electric charging roller 33.

Figure 7:
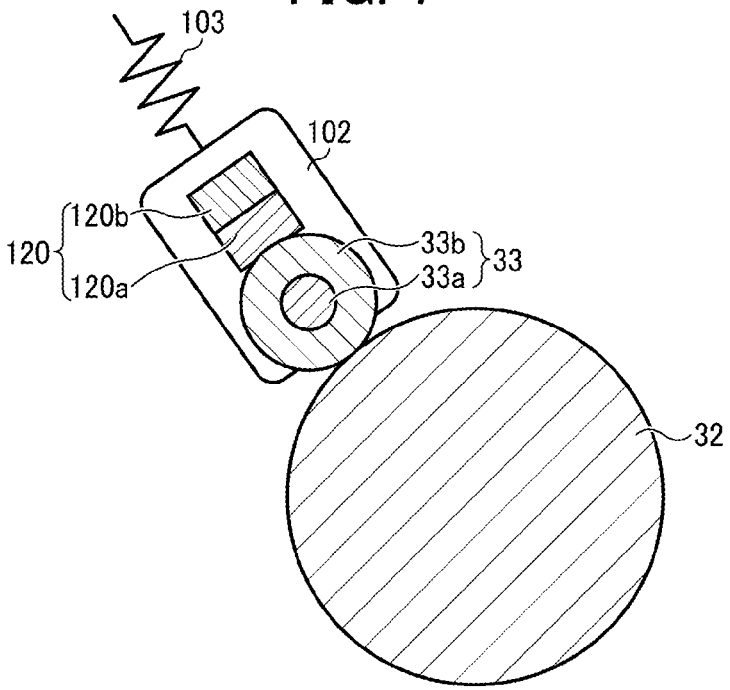
FIG. 7 is a cross-sectional view schematically illustrating an exemplary structure of yet another image forming section of the image forming apparatus according to a second modification of one embodiment of the present invention.

FIG. 7 illustrates a second modification of a charging roller cleaner employed in an image forming apparatus of the present invention. Specifically, in the charging roller cleaner of the second modification, instead of the cleaning roller 100, a cleaning sponge unit 120 configured by an elastic sponge 120*a* made of foamed urethane and a planar stay 120*b* made of metal is disposed.

Specifically, similar to the first modification, the elastic sponge 120*a* and the planar stay 120*b* extend in an axial direction of the electric charging roller 33, and both ends of the planar stay 120*b* in an axial direction thereof are held by the bearing members 102, respectively.

Here, the elastic sponge 120*a* has a parallelepiped shape and removes the toner or the like adhering to the electric charging roller 33 by contacting the electric charging roller 33.

The image forming apparatus employed in the various embodiments of the present invention is not limited to the above-described color image forming apparatus as shown in FIG. 1, and includes a monochromatic image forming apparatus, a copier, a printer, a facsimile, and a multifunction peripheral optionally composed of these devices or the like. Although the image forming apparatus employed in the various embodiments of the present invention employs a tandem type image forming apparatus with the intermediate transfer system, a direct transfer system and a four-cycle system can be employed as well.

According to one aspect of the present invention, in an image forming apparatus, a latent image bearer is rotated forward (i.e., a first forward rotation) after it is rotated backward (i.e., rotated in a direction opposite a direction of rotation of the latent image bearer during an image formation time period) when the image forming apparatus is not forming images to remove the stuffed substances such as toner, etc., remaining in the gap between the tip of the cleaner and the latent image bearer. Further, after the stuffed substances remaining in the gap between the tip of the cleaner and the latent image bearer is removed, the latent image bearer is further forwardly rotated (i.e., a second forward rotation). In the second forward rotation, the latent image bearer is rotated forward by a distance enabling the electric charging roller to rotate at least once. That is, the electric charging roller is driven and rotated by the latent image bearer as the latent image bearer rotates, so that a circumference of the electric charging roller is wholly cleaned by a second cleaner that contacts the electric charging roller as the electric charging roller rotates. Accordingly, since the electric charging roller is cleaned by the second cleaner by removing foreign substances such as paper dust, etc., sufficiently from a surface of the electric charging roller when an image is not formed, defective image formation generally caused by defective charging of the latent image bearer can be likely prevented.

That is, according to one aspect of the present invention, an image forming apparatus includes a latent image bearer to bear a latent image on a circumferential surface thereof, a charging roller driven and rotated by the latent image bearer to electrically charge the latent image bearer while contacting the latent image bearer, a first cleaner to clean the latent image bearer while contacting the latent image bearer, and a second cleaner to clean a surface of the electric charging roller while contacting the surface of the electric charging roller. With such a configuration, an image bearer rotation controller controls the latent image bearer to provide a set of backward rotation, in which the latent image bearer is rotated in an opposite direction to a direction to rotate during image formation, and first forward rotation, in which the latent image bearer is rotated in an opposite direction to that of the backward rotation, at least once during a non-image formation time period. The image bearer rotation controller further controls the latent image bearer to either temporarily stop and start second forward rotation or continuously execute the second forward rotation by at least a distance enabling the electric charging roller to rotate at least once after the set of backward rotation and first forward rotation is completed at least once.

According to another aspect of the present invention, defective image formation generally caused by defective charging of the latent image bearer can be more likely prevented. That is, an air temperature sensor is further provided to measure air temperature, and at least one of the number of executions of the set of backward rotation and first forward rotation and the rotation distance of the second forward rotation is changed in accordance with the air temperature measured by the air temperature sensor.

According to yet another aspect of the present invention, defective image formation generally caused by defective charging of the latent image bearer can be more likely prevented. That is, when the air temperature measured by the air temperature sensor is below a prescribed threshold, the number of executions of the set of backward rotation and first forward rotation is increased while the rotation distance of the second forward rotation either is maintained or is reduced.

According to yet another aspect of the present invention, defective image formation generally caused by defective charging of the latent image bearer can be more likely prevented. That is, a driving time period calculator is further provided to accumulate one of the number of rotations of the latent image bearer and a time period taken by the image forming apparatus to form an image. With such a configuration, at least one of the number of executions of the set of backward rotation and first forward rotation and the rotation distance of the second forward rotation is changed in accordance with the cumulative driving time period calculated by the driving time period calculator.

According to yet another aspect of the present invention, defective image formation generally caused by defective charging of the latent image bearer can be more likely prevented. That is, when the cumulative driving time period calculated by the driving time period calculator exceeds a prescribed threshold, the number of executions of the set of backward rotation and first forward rotation is increased while the rotation distance of the second forward rotation either is maintained or is reduced.

According to yet another aspect of the present invention, defective image formation generally caused by defective charging of the latent image bearer can be more likely prevented. That is, at least one of the number of executions of the set of backward rotation and first forward rotation and the rotation distance of the second forward rotation is changed in accordance with material properties of a recording medium used in image formation.

According to yet another aspect of the present invention, defective image formation generally caused by defective charging of the latent image bearer can be more likely prevented. That is, a first mode, in which the number of executions of the set of backward rotation and first forward rotation is relatively increased while the rotation distance of second forward rotation (executed again) is relatively decreased, and a second mode, in which the number of the set of backward rotation and first forward rotation is relatively decreased while the rotation distance of the second forward rotation is relatively increased, are enabled to be alternatively designated by a user to perform.

Numerous additional modifications and variations of the present invention are possible in light of the above teachings. It is therefore to be understood that within the scope of the appended claims, the present invention may be executed otherwise than as specifically described herein. For example, the image forming apparatus is not limited to the above-described various embodiments and may be altered as appropriate. Similarly, the image forming apparatus driving method is not limited to the above-described various embodiments and may be altered as appropriate. In particular, an order of various steps of the image forming apparatus driving method is not limited to the above-described various embodiments and may be altered as appropriate.

What is claimed is:

1. An image forming apparatus comprising:

a latent image bearer configured to bear a latent image on a surface;

a charging roller configured to charge the latent image bearer;

a first cleaner configured to clean the surface of the latent image bearer;

a second cleaner configured to clean a surface of the charging roller; and a rotation controller configured to clean the charging roller during a non-image formation time period in which the image forming apparatus is not executing image formation, the rotation controller configured to clean the charging roller by, rotating, during the non-image formation time period, the latent image bearer such that the latent image bearer rotates back and forth a number of times in a first direction and a second direction during a first cleaning phase, the second direction being opposite the first direction, and rotating, during the non-image formation time period, the latent image bearer in the first direction during a second cleaning phase such that, during the second cleaning phase, the charging roller rotates a rotational distance corresponding to at least a full revolution, the second cleaning phase being a period of time after the first cleaning phase.

2. The image forming apparatus of claim 1, further comprising;

an air temperature sensor to measure air temperature, wherein the rotation controller is configured to changes at least one of (1) the number of times the latent image bearer rotates back and forth in the first direction and the second direction during the first cleaning phase and (2) the rotational distance of the charging roller during the second cleaning phase, in accordance with the air temperature measured by the air temperature sensor.

3. The image forming apparatus of claim 1, further comprising;

an air temperature sensor to measure air temperature, wherein the rotation controller is configured to increase the number of times the latent image bearer rotates back and forth in the first direction and the second direction during the first cleaning phase while either maintaining or reducing the rotational distance of the charging roller during the second cleaning phase, if the air temperature measured by the air temperature sensor is below a prescribed threshold.

4. The image forming apparatus of claim 1, further comprising:

a driving time period calculator configured to generate a cumulative driving time period by accumulating one of a rotation time period of the latent image bearer and an image formation time period of the image forming apparatus, wherein the rotation controller is configured to changes at least one of (1) the number of times the latent image bearer rotates back and forth in the first direction and the second direction during the first cleaning phase and (2) the rotational distance of the charging roller during the second cleaning phase, in accordance with the cumulative driving time period.

5. The image forming apparatus of claim 1, further comprising;

a driving time period calculator configured to generate a cumulative driving time period by accumulating one of a rotation time period of the latent image bearer and an image formation time period of the image forming apparatus, wherein the rotation controller is configured to increase the number of times the latent image bearer rotates back and forth in the first direction and the second direction during the first cleaning phase while either maintaining or reducing the rotational distance of the charging roller, if the cumulative driving time period accumulated by the driving time period calculator exceeds a prescribed threshold.

6. The image forming apparatus of claim 1, further comprising:

a material property measuring device, the material property measuring device configured to obtain information on material properties of the recording medium used in the image formation, wherein the rotation controller is configured to changes at least one of (1) the number of times the latent image bearer rotates back and forth in the first direction and the second direction during the first cleaning phase and (2) the rotational distance of the charging roller during the second cleaning phase, in accordance with the material properties of the recording medium obtained by the material property measuring device.

7. The image forming apparatus of claim 1, further comprising:

a first mode, in which the number of times the latent image bearer rotates back and forth in the first direction and the second direction during the first cleaning phase is relatively increased while the rotational distance of the charging roller during the second cleaning phase is relatively decreased, and a second mode, in which the number of times the latent image bearer rotates back and forth in the first direction and the second direction during the first cleaning phase is relatively decreased while the rotational distance of the charging roller during the second cleaning phase is relatively increased, wherein the first mode and the second mode are selectable.

8. The image forming apparatus of claim 1, wherein the rotation controller is configured to clean the charging roller by, increasing the number of times the latent image bearer rotates back and forth in the first cleaning phase and decreasing a rotational distance that the charging roller rotates in the second cleaning phase, if the rotational controller is operating in a first mode, and decreasing the number of times the latent image bearer rotates back and forth back and forth in the first cleaning phase and increasing the rotational distance that the charging roller rotates in the second cleaning phase, if the rotational controller is operating in a second mode.

9. The image forming apparatus of claim 1, wherein the rotation controller is configured to rotate the charging roller less than the full revolution during the first cleaning phase.

10. The image forming apparatus of claim 1, further comprising:

a third cleaner between the first cleaner and a transfer roller, the third cleaner configured to clean the surface of the latent image bearer when the latent image bearer rotates in the second direction.

11. A method of driving an image forming apparatus, the image forming apparatus including a first cleaner configured to clean a surface of a latent image bearer, and a second cleaner configured to clean a surface of a charging roller, the method comprising:

bearing a latent image on a circumferential surface of the latent image bearer;

charging the latent image bearer with the charging roller; and cleaning the charging roller during a non-image formation time period in which the image forming apparatus is not executing by, rotating, during the non-image formation time period, the latent image bearer such that the latent image bearer rotates back and forth a number of times in a first direction and a second direction during a first cleaning phase, the second direction being opposite the first direction, and rotating, during the non-image formation time period, the latent image bearer in the first direction during a second cleaning phase such that, during the second cleaning phase, the charging roller rotates a rotational distance corresponding to at least a full revolution, the second cleaning phase being a period of time after the first cleaning phase.

12. The method of claim 11, further comprising:

measuring air temperature with an air temperature sensor; and changing at least one of (1) the number of times the latent image bearer rotates back and forth in the first direction and the second direction during the first cleaning phase and (2) the rotational distance of the charging roller during the second cleaning phase, in accordance with the air temperature.

13. The method of claim 11, further comprising:

measuring air temperature with an air temperature sensor; and increasing the number of times the latent image bearer rotates back and forth in the first direction and the second direction during the first cleaning phase while either maintaining or reducing the rotational distance of the charging roller during the second cleaning phase when the air temperature is below a prescribed threshold.

14. The method of claim 11, further comprising:

generating, via a driving time period calculator, a cumulative driving time period by accumulating one of a rotation time period of the latent image bearer and an image formation time period of the image forming apparatus; and changing at least one of (1) the number of times the latent image bearer rotates back and forth in the first direction and the second direction during the first cleaning phase and (2) the rotational distance of the charging roller during the second cleaning phase in accordance with the cumulative driving time period.

15. The method of claim 11, further comprising:

obtaining material properties of a recording medium used in image formation with a material property measuring device; and changing at least one of (1) the number of times the latent image bearer rotates back and forth in the first direction and the second direction during the first cleaning phase and (2) the rotational distance of the charging roller during the second cleaning phase, in accordance with the material properties of the recording medium.

16. The method of claim 11, further comprising:

providing a first mode, in which the number of times the latent image bearer rotates back and forth in the first direction and the second direction during the first cleaning phase is relatively increased while the rotational distance of the charging roller during the second cleaning phase is relatively decreased;

providing a second mode, in which the number of times the latent image bearer rotates back and forth in the first direction and the second direction during the first cleaning phase is relatively decreased while the rotational distance of the charging roller during the second cleaning phase is relatively increased; and selecting one of the first mode and the second mode based on an input.

17. The method of claim 11, wherein the cleaning cleans the charging roller such that, during the first cleaning phase, the charging roller rotates less than the full revolution.

18. An image forming apparatus comprising:

latent image bearing means for bearing a latent image on a surface thereof;

charging means for charging the latent image bearing means;

first cleaning means for cleaning the surface of the latent image bearing means;

second cleaning means for cleaning a surface of the charging means; and a rotation control means for cleaning the charging means during a non-image formation time period in which the image forming apparatus is not executing image formation, the rotation control means configured to clean the charging means by, rotating, during the non-image formation time period, the latent image bearing means such that the latent image bearing means rotates back and forth a number of times in a first direction and a second direction during a first cleaning phase, the second direction being opposite the first direction, and rotating, during the non-image formation time period, the latent image bearing means in the first direction during a second cleaning phase such that, during the second cleaning phase, the charging means rotates a rotational distance corresponding to at least a full revolution, the second cleaning phase being a period of time after the first cleaning phase.

19. The image forming apparatus of claim 18, wherein the rotation control means is configured to change at least one of (1) the number of times the latent image bearer rotates back and forth in the first direction and the second direction during the first cleaning phase and (2) the rotational distance of the charging means during the second cleaning phase, in accordance with material properties of a recording medium used in an image formation.

20. The image forming apparatus of claim 18, wherein the rotation control means is configured to rotate the charging means less than the full revolution during the first cleaning phase.

* * * * *